US007880391B2

(12) United States Patent
Bakre et al.

(10) Patent No.: US 7,880,391 B2
(45) Date of Patent: Feb. 1, 2011

(54) FALSE FAILURE PREVENTION CIRCUIT IN EMERGENCY BALLAST

(75) Inventors: Shashank Bakre, Woburn, MA (US); Arindam Chakraborty, Burlington, MA (US)

(73) Assignee: Osram Sylvania, Inc., Danvers, MA (US)

( * ) Notice: Subject to any disclaimer, the term of this patent is extended or adjusted under 35 U.S.C. 154(b) by 457 days.

(21) Appl. No.: 12/165,169

(22) Filed: Jun. 30, 2008

(65) Prior Publication Data

US 2009/0322228 A1 Dec. 31, 2009

(51) Int. Cl.
*H05B 37/00* (2006.01)

(52) U.S. Cl. ..... 315/86; 315/160; 315/161; 315/362

(58) Field of Classification Search ..... 315/86–88, 315/160, 161, 200 R, 209 R, 225–226, 312–315, 315/360, 362
See application file for complete search history.

(56) References Cited

U.S. PATENT DOCUMENTS 5,004,953 A * 4/1991 McDonald ..... 315/86
5,811,938 A * 9/1998 Rodriguez ..... 315/86
5,854,538 A 12/1998 Krummel
6,049,178 A * 4/2000 Sheu et al. ..... 315/291
6,107,744 A * 8/2000 Bavaro et al. ..... 315/86
6,140,771 A 10/2000 Luger et al.
6,339,296 B1 1/2002 Goral
6,366,031 B2 4/2002 Klien
6,753,651 B1 * 6/2004 Goral ..... 315/86
6,972,531 B2 12/2005 Krummel
6,987,363 B1 * 1/2006 Goral ..... 315/86
7,084,579 B2 8/2006 Konopka et al.
7,187,132 B2 3/2007 Bakre
7,218,063 B2 5/2007 Konopka et al.

* cited by examiner

*Primary Examiner*—Douglas W Owens
*Assistant Examiner*—Tung X Le
(74) *Attorney, Agent, or Firm*—Senniger Powers LLP

(57) ABSTRACT

A backup ballast used with a primary ballast for providing power to one or more lamps. The backup ballast includes an output switch and a delay circuit. The output switch has a first operating mode for connecting a primary power source via the primary ballast to a first set of the lamps and second operating mode for connecting a backup power source with a second set of the lamps. The output switch operates in the first operating mode when it is energized and in the second operating mode when said it is not energized. The delay circuit is adapted for connecting to the primary power source for receiving power therefrom. The delay circuit is connected to the output switch for energizing it while the power is being received and for a delay period thereafter. The delay circuit includes an energy-storage component for storing energy while the power is being received and discharging the stored energy when the power is not being received in order to energize the output switch for the delay period.

20 Claims, 6 Drawing Sheets

FALSE FAILURE PREVENTION CIRCUIT IN EMERGENCY BALLAST

BACKGROUND

A ballast provides power to a lamp and regulates the current and/or power provided to the lamp. When a lamp (e.g. a fluorescent lamp) nears the end of its usable life or breaks, the resistance of the lamp increases as seen by the ballast. The increased resistance requires the ballast to output higher voltages in order to maintain the current or power transferred to the lamp. Thus, the ballast develops very high voltages (e.g., voltages in excess of 500 volts AC) as the resistance continues to increase. The high voltage poses an electrocution hazard to a technician who needs to replace the old lamp because the increased voltage increases the risk that the electricity will arc to earth ground through the technician as he attempts to replace the lamp. Therefore, some ballasts are equipped with a protection circuit (e.g., an end of lamp life circuit) to prevent high voltage from being provided to the lamp. The protection circuit is configured to detect sudden increases in output voltage and/or output voltages in excess of a threshold value to shut down the ballast operation in response thereto. These ballasts may also have a circuit configured to detect when a lamp has been replaced and to restart the high voltage output of the ballast in response thereto in order to light the replacement lamp (e.g., by resetting the end of lamp life circuit).

A ballast may receive power from multiple sources. For example, ballast systems used in commercial buildings commonly receive power from a utility line supply and from a battery. Such a ballast system includes a primary ballast which provides a lamp with power when the ballast system is operating in a first operation mode (e.g., primary power mode) and a battery powered ballast (broadly, "backup ballast") which provides the lamp with power when the ballast system is operating in a second operation mode (e.g., emergency power mode). The ballast system may include a switching circuit for controlling the operating mode of the ballast system. In particular, the switching circuit is configured to operate the ballast system in the primary power mode when the utility line supply is providing power to the ballast system and to operate the ballast system in the emergency power mode when the utility line supply is not providing power to the ballast system. Accordingly, when the utility line supply is providing power to the ballast system, the primary ballast provides the lamp with the power being supplied by the utility line supply. When the utility line stops providing power to the ballast system (e.g., during a power outage), the backup ballast provides the lamp with power supplied from the battery.

When the ballast system switches between the power sources, changes in the output voltage often occur causing the protection circuit to unnecessarily shut down ballast system operations. For example, the switching circuit generally responds to an interruption of the utility line supply power by immediately switching from the primary power mode to the emergency power mode. As a result, the backup ballast may begin providing power to the lamps before the primary ballast has been properly discharged. The excess output voltage that is discharged from the primary ballast may cause the protection circuit to shut down the output of the primary ballast.

FIG. 1 is a timing diagram for a conventional ballast system which illustrates the responses of components of the ballast system to a power outage event. The primary ballast of the ballast system includes a converter for converting AC (alternating current) voltage received from the utility line supply into a DC (direct current voltage) voltage. The DC voltage is then passed through a filtering capacitor to an inverter. The inverter converts the DC voltage into high frequency AC power for providing to the lamps. A voltage across the filtering capacitor (i.e., DC rail) may be present after the utility line supply is shut off while the filtering capacitor dissipates. Accordingly, as illustrated by the timing diagram in FIG. 1, the inverter remains on for a period of time, denoted $t_D$, after the switching circuit has begun operating the ballast system in the emergency power mode (e.g., after the switching circuit is been shut off). The excess voltage output by the inverter during $t_D$ may trigger the protective circuit (e.g., end of lamp life circuit of the primary ballast) to erroneously detect that the lamps are broken or at the end of their useful lives and shut down the output of the primary ballast. As such, when power is restored to the ballast system via the utility line supply, the ballast system fails to provide power to the lamp since the output of the primary ballast is shut down.

SUMMARY

Embodiments of the invention provide for reliable transitioning for ballast system between a primary power mode in which a primary power source is supplying power for energizing a lamp and an emergency power mode in which a backup power source is supplying power for energizing a lamp. Specifically, embodiments of the invention delay the transition between the primary power mode and the emergency power so that a protection circuit does not unnecessarily shut down ballast system operations.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Other features will be in part apparent and in part pointed out hereinafter.

BRIEF DESCRIPTION OF THE DRAWINGS

Corresponding reference characters indicate corresponding parts throughout the drawings.

DETAILED DESCRIPTION

Embodiments of the invention include a backup ballast for use in conjunction with a primary ballast having a protective circuit associated therewith. The backup ballast has a delay circuit to avoid erroneous operation of the protective circuit.

In particular, the delay circuit delays the backup ballast from providing power to a lamp following a power outage (e.g, failure, interruption) so that the primary ballast has time to properly shut down.

Figure 1:
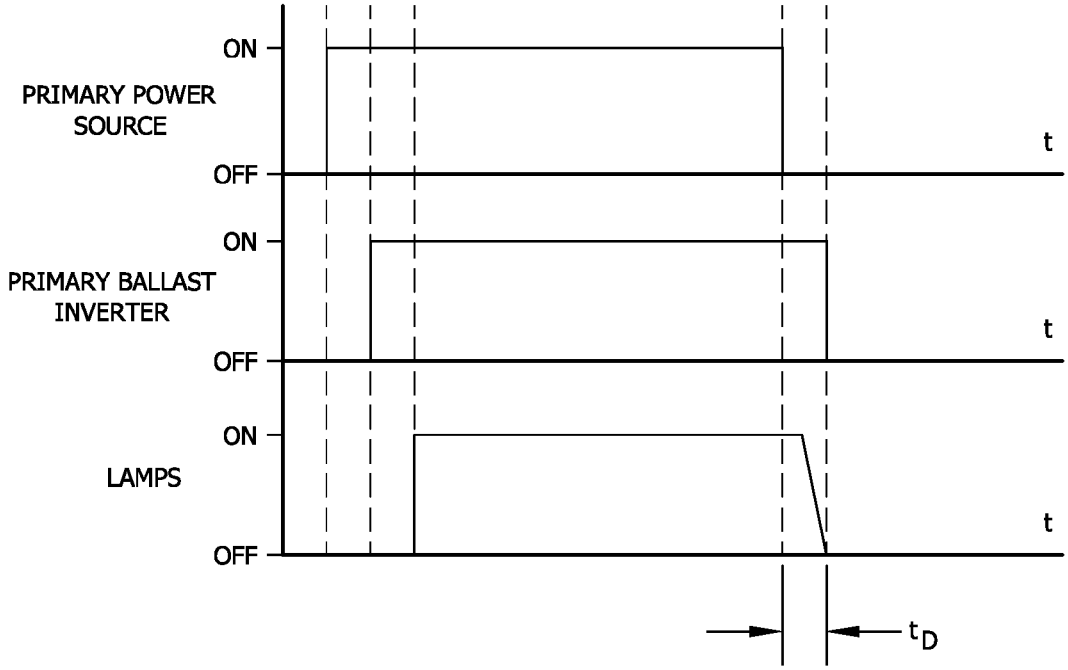
FIG. 1 PRIOR ART
FIG. 1 is a timing diagram for a conventional ballast system which illustrates the operations of components of the conventional ballast system during a power outage event.
Figure 2:
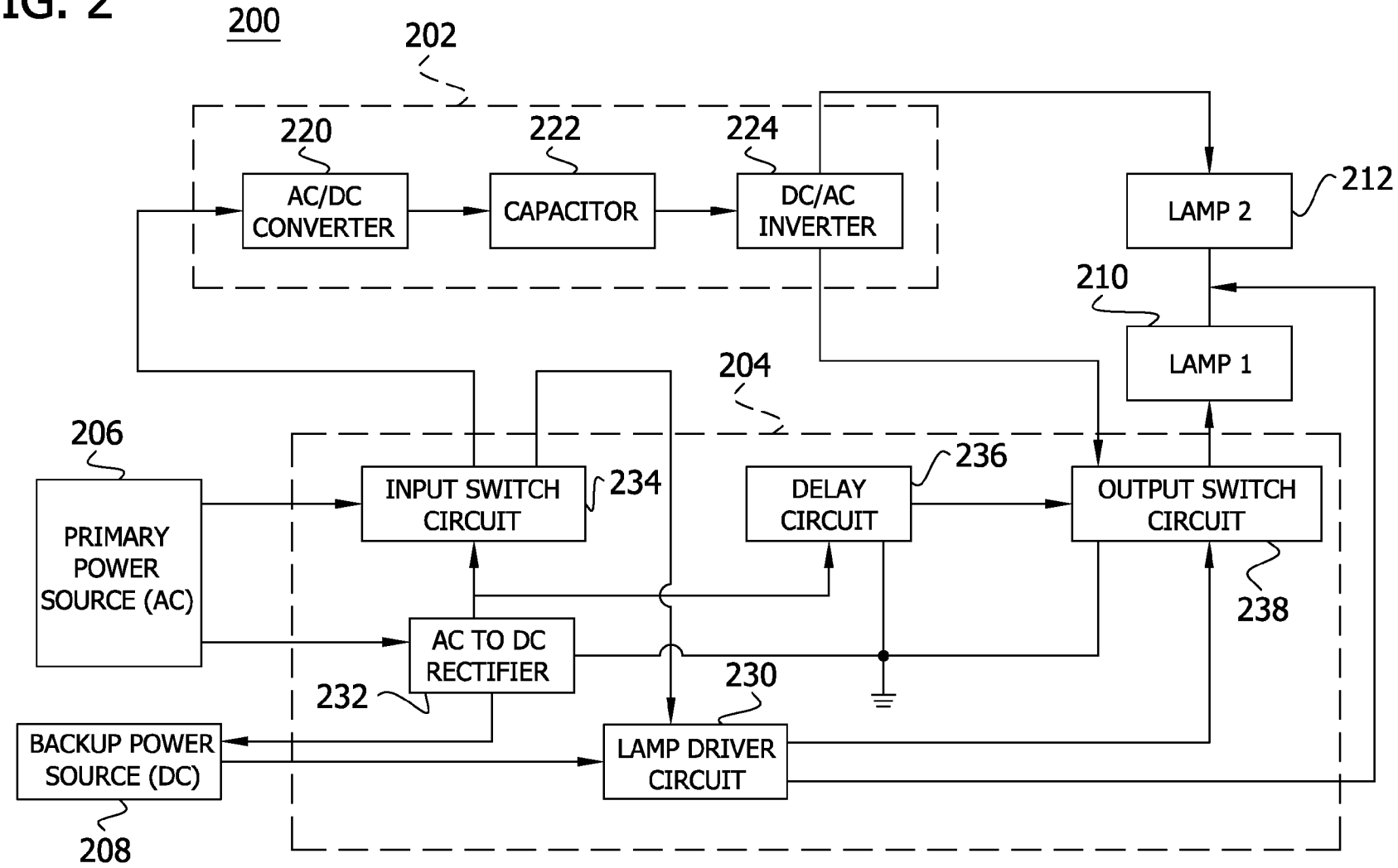
FIG. 2 is a block diagram of an exemplary ballast system having a backup ballast with a delay circuit according to an embodiment of the invention.

FIG. 2 illustrates an exemplary ballast system 200 having a primary ballast 202 and a backup ballast 204 in accordance with an embodiment of the invention. The ballast system 200 is used with a primary power source 206 (e.g., alternating current power source) and a backup power source 208 (e.g., direct current power source) to provide power for energizing a light source (e.g., lamp 1 210, lamp 2 212). The primary power source 206 and/or the backup power source 208 may include one or more voltage sources. In one example, the primary power source 206 is a utility line supply (e.g., 120Vrms AC, 60 Hz) and the backup power source 208 is a (e.g., high temperature 6 volt nickel cadmium battery). Other power sources may be used for the primary power source 206 and the backup power source 208 without departing from the scope of the invention.

The ballast system 200 has three operation modes: (1) primary power mode; (2) delay mode; and (3) emergency power mode. The ballast system 200 is configured to operate in the primary power mode when the primary power source 206 is supplying power to the ballast system 200. In the primary power mode, the primary ballast 202 receives the power supplied by primary power source 206 and, in turn, provides power to a first lamp set 210, 212 (i.e., one or more lamps) for energizing the first lamp set 210, 212. According to the illustrated ballast system 200, the first lamp set 210, 212 includes a first lamp 210 and a second lamp 212. The ballast system 200 is configured to operate in the delay mode for a delay period immediately following a power outage when the primary power source 206 is not supplying power to the ballast system 200. In the delay mode, the primary ballast 202 shuts down. Any remaining power in the primary ballast 202 is discharged to the first lamp set 210, 212 for energizing the first lamp set 210, 212. The ballast system 200 is configured to operate in the emergency power mode immediately following the delay period when the primary power source 206 is not supplying power to the ballast system 200. In the emergency power mode, the backup power source 208 supplies power to the backup ballast 204 receives the power from the primary power source 206 and, in turn, provides power to a second lamp set 210 (i.e., one or more lamps) for energizing the second lamp set 210. According to the illustrated ballast system 200 the second lamp set 210 includes the first lamp 210.

The backup ballast 204 is configured for alternately receiving power from the primary power source 206 and the backup power source 208. In particular, the backup ballast 204 includes one or more input terminals connectable to the primary power source 206, one or more input terminals connectable to the backup power source 208, and a ground terminal connectable to ground potential. In one embodiment, primary power source 206 includes a first voltage source (e.g., 120 volts AC) and a second voltage source (e.g., 277 volts AC). The backup ballast 204 includes a first input terminal connectable to the first voltage source, a second input terminal connectable to the second voltage source, and a third input terminal connectable to the backup power source 208. The backup ballast 204 is operatively connected to either the first voltage source or the second voltage source and to the backup power source 208. Thus, the backup ballast 204 may be selectively connected to either a standard commercial voltage (i.e., 277 volts AC) or normal residential voltage (i.e., 120 volts AC) and a backup battery.

The primary ballast 202 is adapted for connecting to the backup ballast 204 in order to receive AC power supplied by the primary power source 206. The primary ballast 202 includes an AC to DC converter 220, a filtering capacitor 222 (e.g., high value electrolytic capacitor), and a DC to AC inverter 224, which are connected in series, for converting the AC power supplied from the primary power source 206 into high frequency AC power for providing to the first lamp set 210, 212. The backup ballast 204 includes a lamp driver circuit 230 adapted for connecting to the backup power source 208 to receive DC power supplied by the backup power source 208 and to convert the DC power into high frequency AC power for providing to the second lamp set 210. As described below in reference to each of the operating modes, the backup ballast 204 includes a rectifier 232, an input switch circuit 234, a delay circuit 236, and an output switch circuit 238 for controlling the operation mode of the ballast system 200.

In general, the rectifier 232 is adapted for connecting to the primary power source 206 to receive AC power from the primary power source 206 and to convert the AC power to DC power. The input switch, the lamp driver and the delay circuit 236 are each connected to the primary power source 206 via the rectifier 232 and are accordingly operated as a function of the primary power source 206 supplying power to the ballast system 200. The input switch circuit 234 is adapted for selectively connecting the primary power source 206 (e.g., via the input terminal(s)) to the primary ballast 202 so that power from the primary power source 206 can be conducted to the primary ballast 202 when the primary power source 206 is supplying power to the ballast system 200. The delay circuit 236 is connected in series with the output switch circuit 238 for energizing the output switch circuit 238 while the delay circuit 236 is receiving energy from the primary power source 206 (via the rectifier 232) and for a delay period during which the delay circuit 236 is not receiving energy from the primary power source 206. The output switch circuit 238 is adapted for connecting the primary ballast 202 to the first lamp set 210, 212 when the output switch is energized and for connecting the lamp driver to the second lamp set 210 when the output switch is not energized. Applicants note that the scope of the invention does not require all of the listed components. Additionally, components of other structures or types may be used without departing from the scope of the invention.

Primary Power Mode

As discussed above, the ballast system 200 operates in the primary power mode when the ballast system 200 is receiving power from the primary power source 206. In the primary mode of operation, the input switch receives AC power from the primary power source 206 via one input terminal and the rectifier 232 receives AC power from the primary power source 206 via another input terminal. The rectifier 232 converts the received AC power to DC power. The DC power is provided to the lamp driver circuit 230 to disable the lamp driver circuit 230 while the primary power source 206 is supplying the AC power. The DC power may also be provided to the DC backup power source 208 to charge the DC backup power source 208 while the primary power source 206 is supplying the AC power to the ballast system 200. The DC power is provided to the input switch circuit 234, the delay circuit 236, and the output switch circuit 238 to energize those components while the primary power source 206 is supplying the AC power to the ballast system 200.

In particular, the rectifier 232 provides converted DC power to the input switch circuit 234. The input switch circuit 234 receives the DC power which energizes the input switch circuit 234 (broadly, "operating the input switch in a first mode"). While the input switch circuit 234 is in an energized state, the input switch circuit 234 conducts the AC power being received by the input switch circuit 234 from the primary power source 206 to the primary ballast 202.

The primary ballast 202 receives the power supplied by the primary power source 206 and converts it to high frequency AC power. In particular, the converter 220 converts the received AC power (i.e., voltage) into a DC voltage. Exemplary converters include one or more the following converters: boost, buck, buck/boost power factor corrected, and passive power factor corrected. The DC voltage is then passed through the filtering capacitor 222 to the inverter 224. In one example, the filtering capacitor 222 is a high value electrolytic capacitor which holds charge in order to moderate fluctuations in the DC voltage. The inverter 224 converts the DC voltage into high frequency AC power. The high frequency AC power is provided to the first set of lamps 210, 212 when the output switch circuit 238 is energized, as discussed below.

Figure 3A:
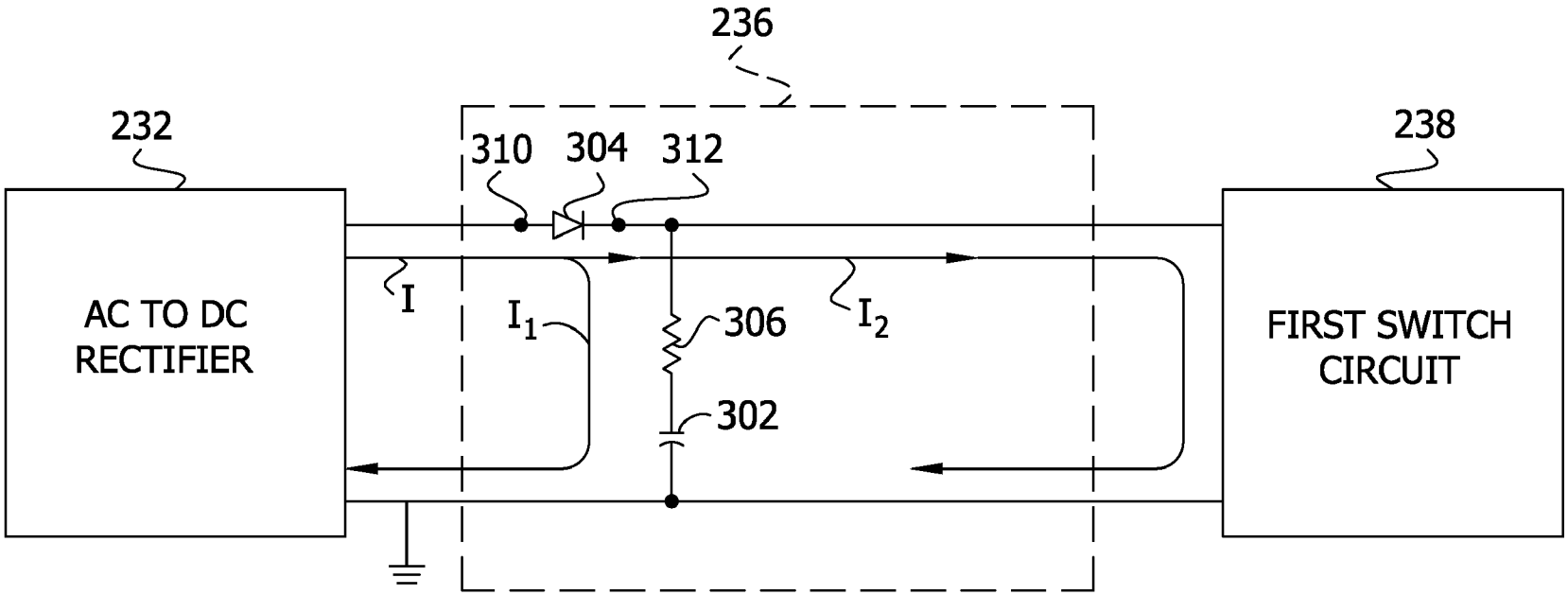
FIG. 3A is a partial block diagram, partial schematic illustrating a delay circuit operating in a primary power mode according to an embodiment of the invention.

The rectifier 232 also provides converted DC power to the delay circuit 236 which receives the DC power. The delay circuit 236 includes an energy-storage component (e.g., capacitor, small battery) which stores a portion of the received DC power. The delay circuit 236 conducts the remaining portion of the received DC power to the output switch circuit 238. FIG. 3A illustrates an exemplary delay circuit 236 operating in the primary power mode according to an embodiment of the invention. The illustrated delay circuit 236 includes a diode 304 (e.g., high speed diode such as a 1N4148 diode), a resistor 306 (e.g., 10 ohms), and a capacitor 302 (e.g., 1000 microfarads). The resistor 306 and the capacitor 302 are connected in series and, together, are connected in parallel with the output switch circuit 238. The diode 304 has a positive terminal 310 which is electrically connected to the rectifier 232 and a negative terminal 312 which is electrically connected to both the resistor 306 and the output switch circuit 238. Applicants note that the delay circuit 236 may include additional or alternate components without departing from the scope of the invention. For example, in one embodiment, a switching component, such as a transistor, is used in place of the diode 304. In another example, a battery is used in place of the capacitor 302. In yet another example, another resistor (not shown) is connected in series with the diode 304 between the diode 304 and rectifier 232 to operate as a current in rush limiter and to provide a time constant while the capacitor 302 discharges (discussed below).

According the illustrated delay circuit 236, the diode 304 receives the DC power provided by the rectifier 232. In particular, the diode 304 conducts the received DC power (e.g., DC current indicated as "I") from the positive terminal 310 to the negative terminal 312. The DC current I is then divided into a first current signal (broadly "first DC power signal"), indicated as "$I_1$" and a second current signal (broadly "second DC power signal), indicated as "$I_2$". The first current signal $I_1$ passes through the resistor 306 and the capacitor 302. The first current signal $I_1$ charges the capacitor 302 as it passes through the capacitor 302. The resistor 306 prevents the capacitor 302 from discharging while the delay circuit 236 is receiving the DC current. The second current signal $I_2$ is provided to the output switch circuit 238 for energizing the output switch circuit 238.

The output switch circuit 238 receives the DC power (e.g., second current signal $I_2$) which energizes the output switch circuit 238 (broadly, "operates the output switch circuit 238 in a first mode"). While the output switch circuit 238 is in an energized state, the output switch circuit 238 electrically connects the primary ballast 202 to the first set of lamps 210, 212. More specifically, while the output switch circuit 238 is in the energized state, the output switch circuit 238 conducts the high frequency AC power generated by the primary ballast 202 from the inverter 224 to the first set of lamps 210, 212 for energizing the first set of lamps 210, 212.

Delay Mode

As discussed above, the ballast system 200 operates in the delay mode for a delay period immediately following a power outage when the primary power source 206 is not supplying power to the ballast system 200. In the delay mode, the delay circuit 236 provides the output switch circuit 238 with power. Accordingly, the output switch continues to electrically connect the primary ballast 202 to the first set of lamps 210, 212 allowing the primary ballast 202 to properly discharge energy to the lamp set 210, 212 so that the protective circuit is not triggered.

In particular, when the primary power source 206 stops supplying power to the ballast system 200, the input switch no longer receives AC power for providing to the primary ballast 202. Accordingly, no power is provided to the primary ballast 202. Additionally, when the primary power source 206 stops supplying power to the ballast system 200, the rectifier 232 no longer receives power from the primary power source 206 for energizing the input switch circuit 234, energizing the output switch via the delay circuit 236, and disabling the lamp driver circuit 230.

As such, the input switch circuit 234 is de-energized (broadly, "operating in a second mode") while the primary power source 206 is not providing power to the ballast system 200. In the de-energized state, the input switch circuit 234 is configured so that the primary power source 206 is electrically disconnected from the primary power source 206.

Figure 3B:
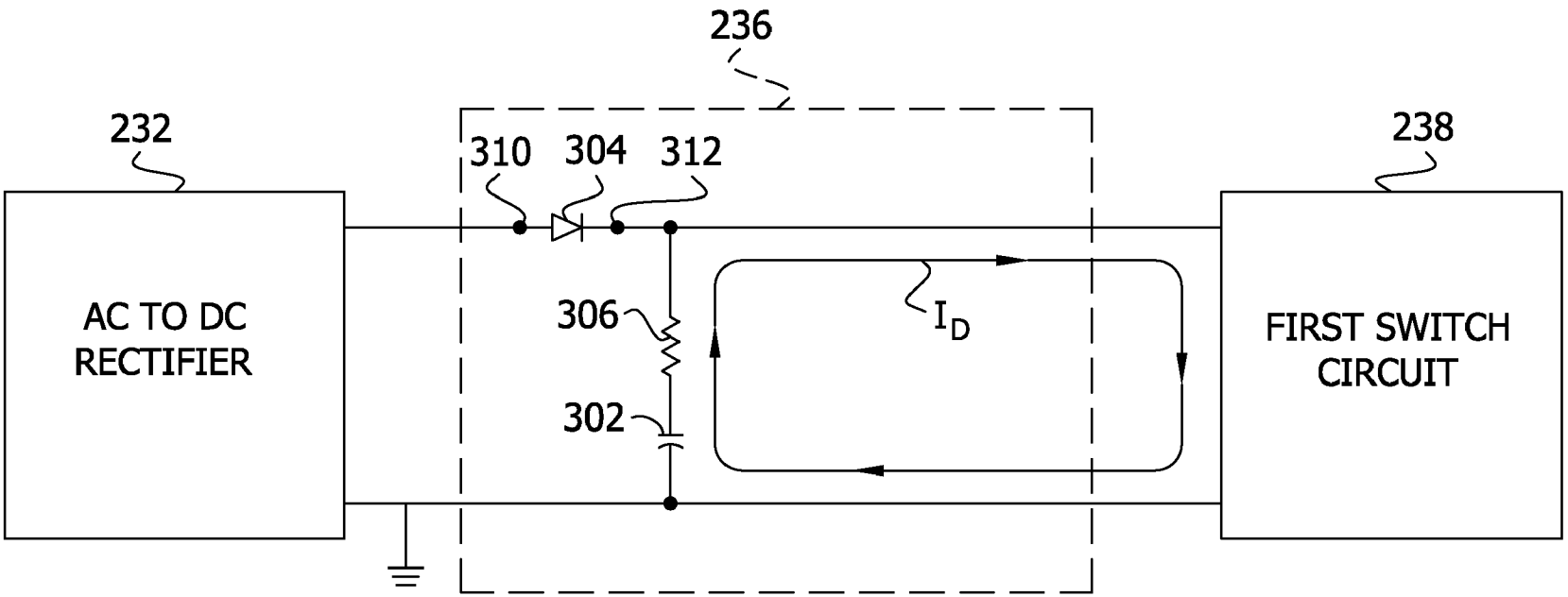
FIG. 3B is a partial block diagram, partial schematic illustrating a delay circuit operating in a delay mode according to an embodiment of the invention.

Responsive to the primary power source 206 ceasing to provide power to the delay circuit 236 (e.g., via the rectifier 232), the delay circuit 236 discharges energy stored by the energy-storage component to the output switch circuit 238 so that the output switch circuit 238 continues to operate in the energized state for a delay period. FIG. 3B illustrates the exemplary delay circuit 236 operating in the delay mode according to an embodiment of the invention. The capacitor 302 discharges energy through the resistor 306 to the output switch circuit 238. The diode 304 controls the path of the discharged energy so that it flows to the output switch circuit 238 rather than back toward the rectifier 232.

The output switch circuit 238 receives the discharged energy which continues to energize the output switch circuit 238. As discussed above, while the output switch circuit 238 is in the energized state, the output switch circuit 238 electrically connects the primary ballast 202 to the first set of lamps 210, 212. Thus, during the delay period, the primary ballast 202 properly discharges since the output switch circuit 238 conducts any power remaining in the primary ballast 202 through the inverter 224 to the first set of lamps 210, 212 for energizing the first set of lamps 210, 212. For example, energy stored by the filtering capacitor 222 during the primary power mode may be converted to high frequency AC power by the inverter 224, and then provided to first set of lamps 210, 212.

Since the delay period is based on the amount of the time that delay circuit 236 is discharging, the components of the delay circuit 236 may be chosen so that the delay period provides a sufficient amount of time for the primary ballast 202 to discharge. For the illustrated delay circuit (FIG. 3A, 3B), the capacitor 302 and resistor 306 values may be selected based on the following relationship:

$$V(t)=V_C e^{-t/RC},$$

wherein

V(t) represents the voltage required at a particular time t;

$V_C$ represents the capacitor steady state voltage; and $c^{-t/RC}$ represents the discharge rate.

In one embodiment, the primary ballast 202 is a rapid start electronic ballast for a fluorescent lamp. A delay period of between about 100 milliseconds and 200 milliseconds allows the primary ballast 202 to properly discharge. In one example, the delay period is provided by the delay circuit 236 having the capacitor 302 be a 1000 microfarad capacitor and the resistor 306 be a 10 Ohm resistor. The diode 304, such as a 14148 diode, can be used with these particular components in order to enable the capacitor 302 to discharge only through the output switch circuit 238.

According to the illustrated embodiment, during the delay mode the lamp driver circuit 230 draws power from the backup power source 208 since it is not receiving DC power from the rectifier 232. However, the power supplied by the backup power source 208 is not provided to the second lamp set 210 during the delay period since the output switch circuit 238 continues to operate in the energized state, connecting the primary ballast 202 to the first lamp set 210, 212.

Emergency Power Mode

As discussed above, the ballast system 200 operates in the emergency power mode immediately following the delay period when the primary power source 206 is not supplying power to the ballast system 200. In other words, the ballast system 200 begins operating in the emergency power mode when the delay circuit 236 completes its discharge such that the output switch circuit 238 no longer receives energy from the delay circuit 236. The ballast system 200 is configured to continue operating in the emergency power mode until the primary power source 206 becomes available (i.e., supplies power to the ballast system 200).

In the emergency mode, the input switch is not receiving AC power from the primary power source 206 and, thus, no power is provided to the primary ballast 202. Additionally, since the primary power source 206 is unavailable, no power is provided by the primary power source 206 for energizing the input switch circuit 234, energizing the output switch circuit 238 via the delay circuit 236, and disabling the lamp driver circuit 230. Accordingly, the input switch circuit 238 remains de-energized thus the primary ballast 202 remains disconnected from the primary power source 206.

The lamp driver circuit 230 is enabled and the backup power source 208 provides power to the ballast system 200. In particular, the lamp driver circuit 230 draws power from the backup power source 208 since it is not receiving DC power from the rectifier 232. Since the output switch circuit 238 no longer receives energy from the delay circuit 236, the output switch circuit 238 is de-energized (broadly "operated in a second state"). The output switch circuit 238 remains de-energized until the primary power source 206 become available. In the de-energized state, the output switch circuit 238 connects the lamp driver circuit 230 to the second set of lamps 210. As such, the output switch circuit 238 conducts power provided by the backup power source 208 from the lamp driver circuit 230 to the second set of lamps 210.

Figure 4:
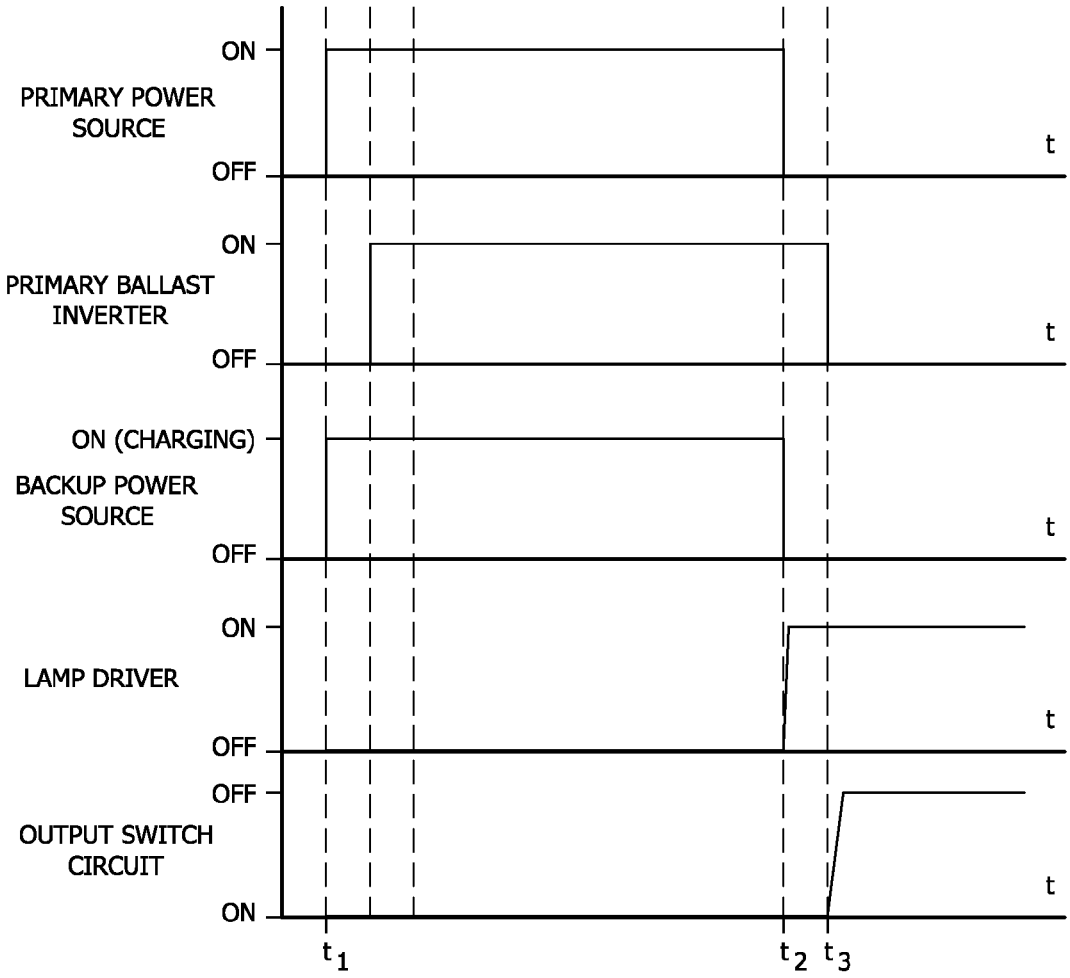
FIG. 4 is a timing diagram for a ballast system which illustrates the operations of components of the conventional ballast system during a power outage event according to an embodiment of the invention.

FIG. 4 is a timing diagram illustrating the operations of the components during the three operating modes. During the time period beginning at t1 and ending at t2, the ballast system 200 is operating in the primary power mode since the primary power source 206 is on (i.e., supplying power to the ballast system 200). AC power from the primary power source 206 is provided to the primary ballast 202. As such, the primary ballast inverter 224 is turned on (i.e., is energized, begins converting the received power to high frequency AC power for providing to the first lamp set 210, 212) shortly thereafter. The backup power source 208 charges (i.e., on) and the lamp driver circuit 230 is disabled (i.e., off) while the primary power source 206 is turned on. The delay circuit 236 receives energy from the primary power source 206 and stores energy in the energy storage component 302 and conducts energy to the output switch circuit 238. Thus, the output switch circuit 238 is energized while the primary power source 206 is turned on. In particular, the primary ballast inverter 224 is operatively connected to the first lamp set 210, 212 so that the first lamp set 210, 212 is energized with the high frequency AC power.

During the time period beginning at t2 and ending at t3 ("delay period"), the ballast system 200 is operating in the delay mode. In particular, the primary power source 206 is turned off at t2 (i.e., primary power source 206 stops providing power to the ballast system 200, primary power source 206 become unavailable, power outage occurs). As such, the backup power source 208 is no longer charged with power from the primary power source 206 and the lamp driver circuit 230 is enabled. The primary ballast 202 inverter 224 remains on even though the primary power source 206 is turned off since the components of the primary ballast 202 are still being discharged. During the delay period, the delay circuit 236 discharges the energy stored during the time period t1 to t2 to the output switch circuit 238. Thus, the output switch circuit 238 remains energized during the delay period so that the primary ballast 202 can be discharged without triggering the protective circuit.

After the delay period (i.e., after time t3), the ballast system 200 is operating in the emergency power mode. In particular, the primary power source 206 remains off. Likewise, the backup power source 208 is not being charged with power from the primary power source 206 and the lamp driver circuit 230 is enabled. The primary ballast inverter 224 is properly shut off since the components of the primary ballast 202 were discharged during the delay period. The delay circuit 236 no longer energizes the output switch circuit 238 since it is not receiving power from the primary power source 206 and has discharged the stored energy during the delay period. Thus, the output switch circuit 238 is de-energized after the delay period. In particular, the lamp driver circuit 230 is operatively connected to the second lamp set 210 so that the second lamp set 210 is energized with the energy supplied by the backup power source 208. The output switch circuit 238 remains de-energized until the primary power source 206 is turned on.

Figure 5:
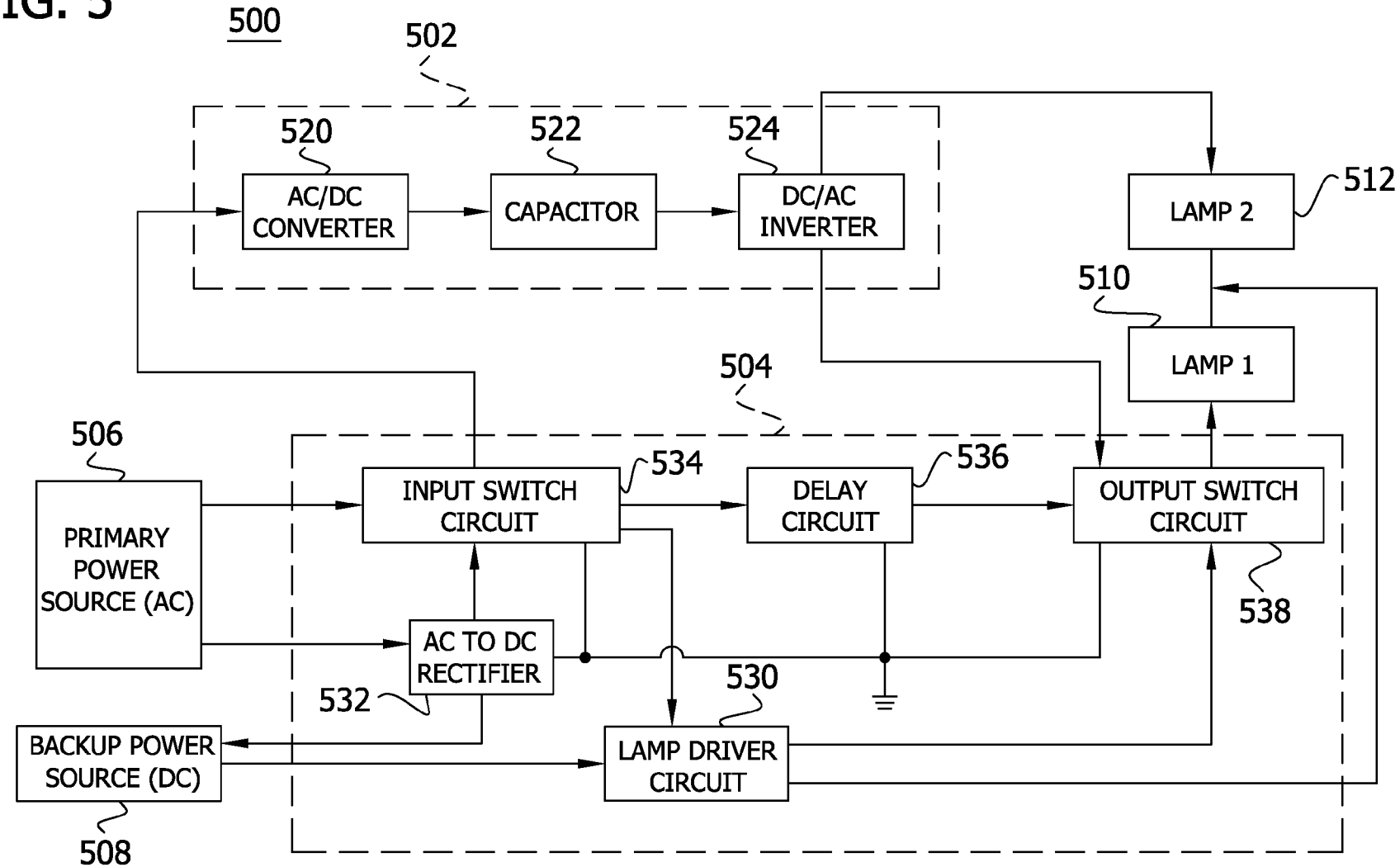
FIG. 5 is a block diagram of an exemplary ballast system having a backup ballast with a delay circuit according to an embodiment of the invention.

Referring to FIGS. 2 and 5, one skilled in the art will recognize that the input switch circuit 234, 534 and the output switch circuit 238, 538 may be configured in a variety of alternative ways. For example, the ballast system 200 illustrated in FIG. 2 has the input switch circuit 234 connected in parallel with the delay circuit 236 and the output switch circuit 238 connected in series. FIG. 5 illustrates another exemplary ballast system 500 in which like elements share like reference numbers with those in FIG. 2. The ballast system 500 has the input switch circuit 534, the delay circuit 536, and the output switch circuit 538 connected in series. As such, when the rectifier 532 provides DC power to the input switch circuit 534, the input switch circuit 534 conducts DC power to the delay circuit 536, which in turn conducts DC power to the output switch circuit 538. Thus, like the ballast system 200 in FIG. 2, the DC power provided by the rectifier 532 is used to energize the input switch circuit 534, the delay circuit 536, and the output switch circuit 538.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Embodiments of the invention may be implemented with computer-executable instructions. The computer-executable instructions may be organized into one or more computer-executable components or modules. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A backup ballast for use in combination with a primary ballast for providing power to one or more lamps, said backup ballast comprising:

an output switch circuit having a first operating mode for electrically connecting a primary power source via the primary ballast to a first set of the one or more lamps, and said output switch circuit having a second operating mode for electrically connecting a backup power source with a second set of the one or more lamps, wherein said output switch circuit operates in the first operating mode when said output switch circuit is energized and said output switch circuit operates in the second operating mode when said output switch circuit is not energized; and a delay circuit adapted for electrically connecting to the primary power source for receiving power from the primary power source, said delay circuit being electrically connected to the output switch circuit for energizing said output switch circuit while said power is being received and for a delay period thereafter, wherein said delay circuit includes an energy-storage component for storing energy while said power is being received and for discharging the stored energy when said power is not being received in order to energize the output switch circuit for the delay period.

2. The backup ballast of claim 1 further comprising a rectifier adapted for electrically connecting to the primary power source for receiving power from the primary power source, said rectifier being electrically connected to the delay circuit, wherein rectifier converts the alternating current power to direct current power when said power is being received and provides said direct current power to the delay circuit, wherein said delay circuit is adapted for electrically connecting to the primary power source via the rectifier.

3. The backup ballast of claim 1 wherein the output switch circuit and the delay circuit are connected in series.

4. The battery powered ballast of claim 1 wherein the energy storage component is a capacitor.

5. The battery powered ballast of claim 4 wherein the delay circuit further comprises a diode and a resistor, said diode having a positive terminal adapted for electrically connecting to the primary power source via a rectifier, said diode having a negative terminal connected to the output switch and to the resistor, said resistor connected in series to said capacitor.

6. The battery powered ballast of claim 1 wherein the energy storage component is a battery.

7. The battery powered ballast of claim 1 wherein the delay period is between about 100 milliseconds and 200 milliseconds, said delay period allowing the primary ballast to properly discharge.

8. The battery powered ballast of claim 1 wherein the first set of lamps includes a first lamp and the second set of lamps includes said first lamp and a second lamp.

9. A method for energizing one or more lamps in a lighting system when power from a primary power source becomes unavailable, said lighting system includes a primary ballast for providing a first set of the one or more lamps with power supplied by a primary power source and a backup ballast for providing a second set of the one or more lamps with power supplied by a backup power source, said method comprising:

discharging energy stored by an energy-storage component in the backup ballast;

energizing an output switch circuit with the energy being discharged, said energized output switch circuit connecting the primary power source to the first set of one or more lamps; and de-energizing the output switch circuit when the energy-storage component has been discharged, said de-energized output switch circuit connecting the backup power source to the second set of one or more lamps.

10. The method of claim 9 further comprising maintaining the output switch circuit in a de-energized state until the primary power source becomes available.

11. The method of claim 9 further comprising enabling a lamp driver circuit, said enabled lamp driver circuit receiving power from the alternate power source and said de-energized switch connecting the alternate power source to the second set of one or more lamps via said lamp driver circuit.

12. The method of claim 9 wherein said energizing includes energizing an output switch for between about 100 milliseconds and 200 milliseconds with the energy being discharged, said energized output switch connecting the primary power source to the first set of one or more lamps.

13. The method of claim 9 wherein the first set of lamps includes a first lamp and the second set of lamps includes said first lamp and a second lamp.

14. The method of claim 9 wherein the energy-storage component is a capacitor and the energy is discharged through a resistor connected in series with said capacitor.

15. The method of claim 9 wherein the energy-storage component is a battery.

16. A ballast system for providing power to a lamp, said ballast system comprising:

a primary ballast for providing power from a primary power source to the lamp when said primary ballast is operably connected to and energized by said primary power source; and a backup ballast for providing power from a backup power source to the lamp when the primary ballast is not energized by the primary power source, said backup ballast comprising:

a lamp driver circuit for supplying power to the lamp from the backup power source when said lamp driver circuit is enabled and the lamp is operably connected said lamp driver;

a rectifier adapted for connecting to the primary power source for receiving alternating current power from the primary power source, wherein said rectifier converts the alternating current power to direct current power when said power is received from the primary power source;

an input switch circuit adapted for connecting to the primary power source, said input switch circuit being connected to the rectifier for receiving direct current power from said rectifier, wherein said input switch circuit conducts power from the primary power source to the primary ballast when said input switch circuit is receiving direct current power from the rectifier, and wherein said input switch circuit enables the lamp driver circuit when said input switch circuit is not receiving direct current power from the rectifier;

an output switch circuit for connecting the lamp to the lamp driver when said output switch circuit is energized and for connecting the lamp to the primary ballast when said output switch circuit is de-energized; and a delay circuit connected to the rectifier for receiving direct current power from said rectifier and connected to the output switch circuit, wherein said delay circuit energizes the output switch circuit when said delay circuit is receiving direct current power from the rectifier and for continuing to energize the output switch circuit for a delay period during which said delay circuit is not receiving direct current power from the rectifier, and wherein the output switch circuit is de-energized when the delay period terminates and the delay circuit is not receiving current power from the rectifier.

17. The lamp ballast of claim 16 wherein the primary ballast stores energy while the primary ballast is energized by the primary power source and wherein the stored energy is discharged during the delay period.

18. The lamp ballast of claim 16 wherein the input switch circuit and the output switch circuit are connected in series.

19. The lamp ballast of claim 16 wherein the output switch circuit is connected in series with the delay circuit and said output switch circuit and said delay circuit in series connection are connected in parallel with the input switch circuit.

20. The lamp ballast of claim 16 wherein the delay circuit includes a diode, a capacitor, and a resistor, said diode connected to said resistor and said capacitor connected in series with said resistor.

* * * * *